United States Patent [19]

Palmer

[11] 4,158,248

[45] Jun. 19, 1979

[54] MOBILE CLEANING UNIT

[76] Inventor: Michael C. Palmer, 6209-183rd Pl., SW., Lynnwood, Wash. 98036

[21] Appl. No.: 768,389

[22] Filed: Feb. 14, 1977

[51] Int. Cl.[2] ..... A47L 5/12

[52] U.S. Cl. ..... 15/321; 15/340; 180/53 R; 192/3.59

[58] Field of Search ..... 180/53 R; 192/3.59; 15/320, 321, 340

[56] References Cited

U.S. PATENT DOCUMENTS

| | | | |
|---|---|---|---|
| 2,800,208 | 7/1957 | Binder | 192/3.59 |
| 3,599,869 | 8/1971 | Oberdorfer | 134/123 X |
| 3,670,359 | 6/1972 | Gutbrod | 15/340 X |
| 3,736,619 | 6/1973 | Zamboni | 15/320 X |
| 3,828,878 | 8/1974 | Clapsaddle, Jr. | 180/53 FE |
| 3,902,219 | 9/1975 | Jones | 15/321 X |

*Primary Examiner*—Christopher K. Moore

[57] ABSTRACT

A self-contained mobile cleaning unit mounted within a vehicle and including selectively engageable elements powered by the vehicle engine to drive auxiliary apparatus necessary to the cleaning process. The selectively engageable auxiliary apparatus includes a pump and a vacuum blower. The cleaning apparatus is controlled in its operation by a series of switches mounted in parallel such that the apparatus will not function unless all of the switches are actuated. A quick release interconnecting apparatus permits the operator to secure the necessary conduits to the exterior of the vehicle and transmit the cleaning liquid and vacuum to the point of operation, the waste liquid being returned to the vehicle and stored therein.

4 Claims, 3 Drawing Figures

MOBILE CLEANING UNIT

BACKGROUND OF THE INVENTION

It is well recognized that carpeting is indeed a great asset with respect to homes, businesses and institutions. Carpeting serves as a protective floor covering as well as providing acoustical treatment generally making conditions far more tolerable to people involved therein.

Because of the particular nature of carpeting, it is virtually impossible for each homeowner and/or business or institution to have apparatus on hand to accomplish the cleaning necessary to retain the attractiveness and assure long life.

There is, of course, a greal deal of debate and disagreement as to whether or not the best way to clean a carpet is with an alkaline solution, a water solution or some other chemical mixture. It is also well known that a majority of supermarkets or the like in metropolitan areas have available for lease small portable carpet cleaning devices which allow the homeowner to scrub the carpet at far less expense than commercially available.

There is no question, however, but what there are many times when the only reasonable approach to a complete cleaning is to have an independent commercial cleaner come to the location of the carpet and perform the cleaning operation. There are several different methods whereby a carpet may be cleaned. Industrial type machines which approximate on a large scale those machines that are available for lease in the local supermarket and utilize chemical cleaning solutions are perhaps best known. Another very popular method of cleaning carpet is the utilization of a steam or hot water bath. These methods require a source of liquid, a heating tank and a means to both pump the water under pressure to the place of cleaning and to vacuum the dirty cleaning fluid out of the carpet.

The traditional method of cleaning carpets with water utilize portable apparatus which can be taken to the site and, which although transported by any sort of vehicle, are self-contained in that they include a gas fired boiler or the like, a gasoline engine for driving the water and vacuum pump and a storage container for containing the dirty fluid.

Some of the disadvantages of the type of equipment currently in use lies in the fact that it is not permanently installed in the vehicle and therefore, occasionally may be attempted to be moved in an inappropriate vehicle and further when being moved from place to place must be secured in position. Further, this type of apparatus is subject to damage during the continual on and off loading, either at the carpet cleaners place of business where he services the equipment or at the place of cleaning when it is necessary to take the equipment from the vehicle closer to the carpeting. Another disadvantage of this type of equipment lies in the fact that in addition to the additional expense, because of the necessity of making it self-powered, many times the source of power will be a small gasoline engine which requires adequate ventilation and protection for curious by-standers, increasing the cost and the weight.

Further, with the advent of laws which make safety features mandatory upon equipment which is used in the public domain it will become imperative that further precautions be used with respect to this portable equipment.

Prior art known to the inventor dealing with auxiliary functions and apparatus mounted upon and powered by motor vehicles include U.S. Pat. No. 1,846,198 granted to Gulledge on Feb. 23, 1932. This particular patent deals with a truck mounted dusting and spraying apparatus wherein an agitator and a pump are both driven by a power takeoff from the motor of the truck.

U.S. Pat. No. 2,199,090 granted to Palmer on Apr. 30, 1940 teaches the utilization of the rotary motion of the fan belt or the like to drive a compressor system for air cooling, refrigeration or the like.

U.S. Pat. No. 2,467,077 granted to Brunken on Apr. 12, 1949 teaches the concept of a hydraulic coupling or torque converter to control the operation of engine accessories or other instrumentalities driven by the engine.

U.S. Pat. No. 2,606,624 granted to Chiotte on Aug. 12, 1952 teaches the utilization of an electrical generator system driven directly from a power takeoff shaft of a motor vehicle.

U.S. Pat. No. 2,663,459 granted to LaGrange etal on Dec. 22, 1953 teaches the concept of an automatically closed discharge valve which is controlled by the operation of the main engine of a motor vehicle.

U.S. Pat. No. 2,875,746 granted to Brice etal on Mar. 3, 1959 teaches the concept of a particularly configured bracket means for supporting engine driven accessories.

U.S. Pat. No. 2,911,961 granted to McRae on Nov. 10, 1959 relates to an engine accessory drive capable of driving engine accessories at two distinct speed ratios and utilizing a clutch as the linking member.

U.S. Pat. No. 3,033,302 granted to Ball on May 8, 1962 teaches the concept of vibration absorbing mounting means for belt driven accessory.

U.S. Pat. No. 3,599,869 granted to Operdorfer on Aug. 17, 1971 teaches the concept of a clutch engageable pump means for a self-contained car washing apparatus.

U.S. Pat. No. 3,828,878 granted to Clapsaddle Jr. on Aug. 13, 1974 deals with a power takeoff assembly adapted for installation at the front end of the vehicle engine within the engine compartment.

With the above noted prior art and problems in mind, it is an object of the present invention to provide a self-contained mobile cleaning system wherein the apparatus necessary for cleaning functions are fixedly secured to the interior of a vehicle and the necessary apparatus for performing a cleaning function is selectively driven by the main engine for the vehicle.

Another object of the present invention is to provide a novel mounting arrangement for auxiliary devices located in an engine compartment of greatly reduced size driven by the engine of a motor vehicle.

It is a still another object of the present invention is to provide a self-contained cleaning apparatus wherein the necessary equipment to perform the cleaning function, with the exception of the hoses and the carpet contacting apparatus, are totally self-contained within the vehicle which includes the necessary safety devices to prevent inadvertent operation of the apparatus.

Yet another object of the present invention is to provide an engine powered steam cleaning apparatus mounted within a truck wherein the happening of a preselected set of events will engage the necessary pumping apparatus and actuate the cleaning operation, an operation finally controlled from the remote cleaning site.

DETAILED DESCRIPTION OF THE DRAWINGS

Figure 1:
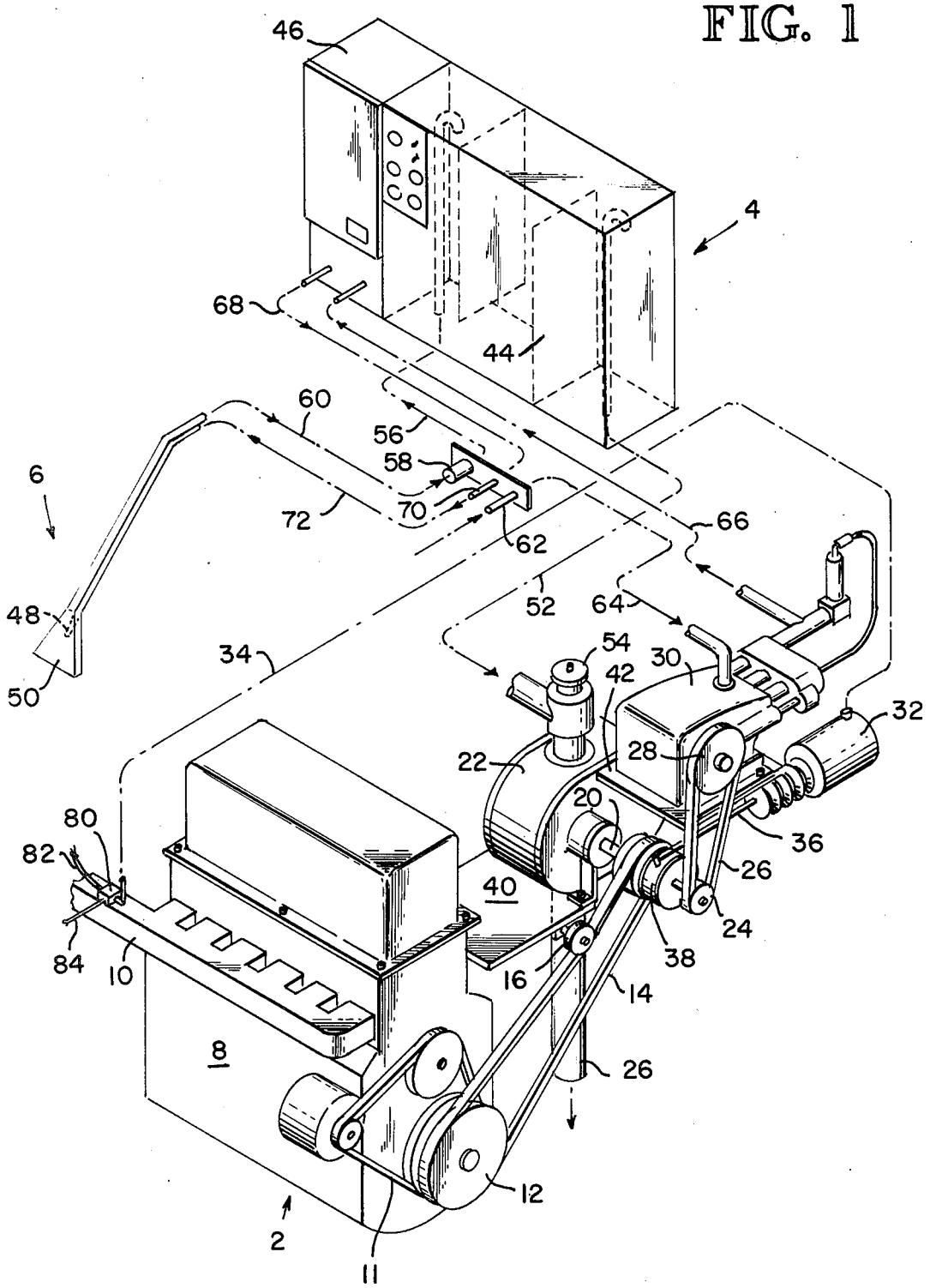
FIG. 1 is a perspective, partially schematic and partially in exploded form, of the cleaning system and required elements for the cleaning operation.

As seen in FIG. 1, the present invention consists in general of three separate components. The first being designated generally as 2 includes the engine for driving the motor vehicle and the auxiliary apparatus as will be described in greater detail hereinafter mounted thereon or adjacent thereto. The chemical supply and waste storage apparatus designated generally as 4 and the actual cleaning apparatus designated generally as 6.

It will be obvious as the description proceeds that there need not be any particular spatial relationship between the various general components since the only connections between the basic driving components 2 and the storage and supply components 4 are either electrical or fluid conduits. Likewise, the only connections between the storage and supply components 4 and the cleaning apparatus 6 are fluid conduits, and depending upon the pressure and vacuum involved these conduits may reach substantial lengths.

Referring now to FIG. 1 in particular, it can be seen that a typical internal combustion engine 8 having a manifold 10, the usual belt driven apparatus such as water pumps, alternators or the like mounted to the front of the engine 8 and driven by a fan belt 11 and a pulley 12. The pulley 12 also drives a secondary belt 14 which passes idler wheel 16 and drives pulley 18 which, as will be described hereinafter, is selectively engaged with shaft 20 which drives pump means for creating a negative pressure 22 and pulley 24 keyed thereon. Also connected to pump means 22 is a conduit 26 which interconnects with a muffler or silencer for obvious reasons.

Pulley 24 has mounted thereon a belt 26 which drives pulley 28 drivingly secured to the shaft of water pump 30.

Vacuum cylinder 32 mounted to plate 42 is connected to the manifold by vacuum line 34 and has an outwardly extending rod 36 which actuates clutch 38 as will be described hereinafter.

Since it is obvious that the motivating power for both the pump 22 and the water pump are derived directly from and thus are mechanically linked with the engine which drives the vehicle, they are located within the engine compartment adjacent the engine. For example, pump 22 is bolted to mounting plate 40 which is either secured to the engine block or to the framework of the vehicle adjacent the engine block. Mounting plate 42 which supports the water pump 30 as well as the vacuum cylinder 32 is bolted directly to the pump 22 but could equally well be placed differently with different space accommodations.

The supply and storage compartments generally designated as 4 include a large waste storage tank 44 having a plurality of baffles therein to control the flow of fluid as well as a propane water heater 46 which heats the water to a temperature of approximately 210°.

The chemicals may either be added to the water automatically or in batch amounts as necessary.

The individual cleaning the carpet although having control of the operation through the various switch control mechanisms has only the cleaning apparatus or vacuum head sweeper 6 in hand with the necessary remote control. As is explained hereinafter, the vacuum head includes a spray nozzle 48 and the vacuum head 50.

Looking now at the operation of the device, as can be seen, conduit 52 leads from the vacuum pump 22 which includes a safety pop-up valve 54 to the storage tank 44 and keeps the tank under constant negative pressure. The vacuum is carried via conduit 56 to a quick disconnect coupling 58 in the side of the vehicle whereat conduit 60 which is attached to the vacuum head 50 may be secured.

Fresh water under pressure is supplied to quick disconnect coupling 62 at the exterior of the vehicle, is transmitted by conduit 64 to pump member 30 and then transferred by conduit 66 to the heater 46. After being heated the water is transmitted via conduit 68 to another quick disconnect coupling 72 to spray nozzle 48. It is understood that the liquid passing through conduit 72 and spray nozzle 48 is under extremely high pressure and at approximately 210° and includes the necessary cleaning chemicals. As the hot spray is applied to the carpet, the vacuum head 50 removes the liquid including the material removed from the carpet and returns it to storage tank 44.

As will be explained hereinafter, the control of the clutch cylinder 32 by the vacuum from the manifold 10 is by solenoid 80 which has a pair of leads 82 interconnected with the master switch and safety features as explained hereinafter. Also interconnected at this point is a bleed conduit 84.

Figure 2:
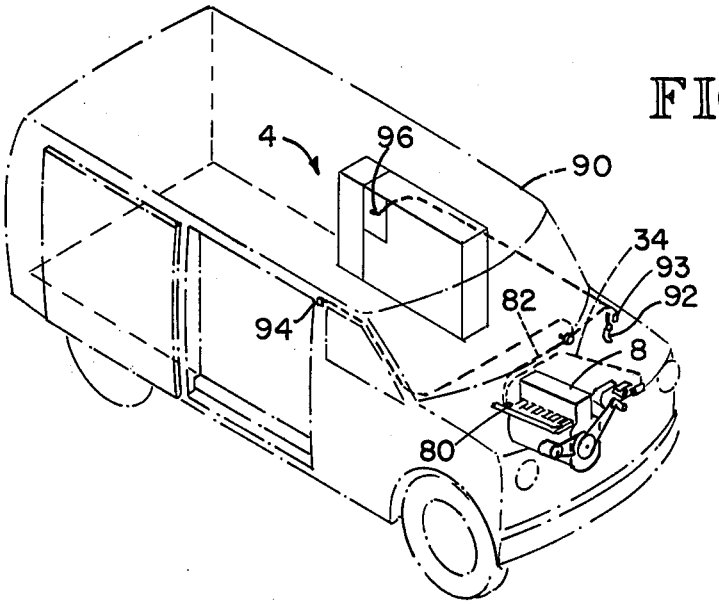
FIG. 2 is a perspective view of an arrangement within a van of the inventive mobile cleaning system.

Looking now in particular at FIG. 2, it can be seen that the self-contained cleaning apparatus is contemplated being installed in a van type vehicle 90. The engine 8 and the auxiliary apparatus are mounted within the engine compartment adjacent the engine itself. Further to be seen in this view is that the emergency brake lever 92 has a switch 93 mounted adjacent thereto which is engaged or turned on when the emergency brake is engaged, this switch is in series with a staging switch 94 adjacent the door of the van and the master switch 96 upon the control panel. The switches 93, 94 and 96 are in series such that the apparatus cannot be operated unless the vehicle is in a stopped condition with the emergency brake on. The master switch 96 must be actuated as well as the staging switch 94 thereby preventing accidental operation which could be dangerous to individuals located in the proximity. Further, engaging the auxiliary equipment when the engine is turning at a rapid rate could destroy or damage the equipment, thereby necessitating speed control mechanism. Upon actuation of all the switches 93, 94 and 96, solenoid 80 is actuated and, as explained above, the clutch is engaged in the mechanism is rendered operational requiring only the appropriate signal from the remote operator.

Thus, when the vehicle is parked, the emergency brake engaged, the engine running at an acceptable speed, and the switches actuated, the clutch will be engaged thus driving the pumps necessary to perform the operation. As noted above, the clutch is prevented from engagement until the conditions are met. As is well known, when the engine is idling a vacuum is generated, thus creating sufficient negative pressure to operate the clutch. See U.S. Pat. No. 3,823,699 granted to Adair on July 16, 1974.

Figure 3:
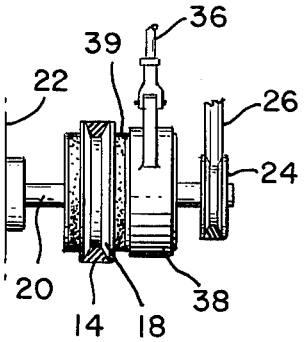
FIG. 3 is an enlarged view of the selective drive engagement.

Referring now to FIG. 3, it can more easily be seen that the means for providing selective operation of the mechanism includes the clutch member 38 which is actuated by rod 36 interconnected with the vacuum cylinder not shown but described hereinabove. The movement of rod 36 causes the clutch member 38 to turn upon a threaded portion of the rod 20 moving leftwardly as seen in this view against the clutch plate 39 locking the pulley 18 to the shaft 20 which, as noted hereinabove, directly drives the pump 22 and the pulley 24 which in turn drives the water pump.

In operation, the unit mounted within the vehicle is driven to the site and parked in proximity to the area to be cleaned. The operator engages the parking brake and places the transmission in park. Upon assuring himself that the water is adequately heated and the apparatus has sufficient operational pressure, connects the hose from the cleaning head, actuates the staging switch and proceeds to the cleaning site. The operation of the cleaning head is remotely controlled by necessary switching on the wand.

Thus as can be seen, the present invention includes a novel means of driving auxiliary apparatus from the engine of the motor driven vehicle thereby allowing the utilization of a mobile self-contained unit without the necessity of having auxiliary and auxiliary power source. There are sufficient safety features included within the apparatus such that it cannot be operated inadvertently thereby rendering the present invention an extremely attractive practical and safe device for the cleaning of carpets or the like.

What is claimed is:

1. Self-contained mobile cleaning apparatus located within and forming a permanent part of a vehicular structure including the frame, wheels, and engine and a cargo carrying area, wherein the majority of the cargo area continues to be available for use as designed and the necessary operation and control mechanisms are mounted within the engine compartment said apparatus comprising: storage means and supply means for the necessary cleaning agents and the soiled, returned fluid and heating means for the cleaning agents within the cargo area, means for creating a positive pressure and means for creating a negative pressure and driven by the engine mounted within the engine compartment, selectively engageable clutch means mounted within the engine compartment driving the means for creating negative pressure, remote, portable cleaning means for delivering cleaning agents to the area to be cleaned and for returning the soiled fluid, conduits functionally interconnecting the means for creating positive pressure and negative pressure, storage and supply means and the remote cleaning means for conducting the cleaning solution and the soiled liquid, and means preventing use of the apparatus unless the vehicle is parked.

2. Mobile cleaning apparatus as in claim 1, wherein the fluid pump means and said means for generating negative pressure means are driven by a belt which is driven by the engine.

3. Mobile cleaning apparatus as in claim 1, wherein the vehicular structure comprises a standard cargo van.

4. A mobile cleaning unit mounted upon a vehicle having an engine compartment and a cargo area wherein the engine for the vehicle unit further serves to drive the cleaning apparatus comprising:

fluid pump means and means for generating negative pressure, mounted within the engine compartment, storage means and supply means mounted within the cargo area for respectively containing the necessary cleaning fluid and receiving the returned, soiled cleaning fluid, conduits respectively interconnecting said fluid pump means and said means for generating negative pressure with said supply means and said storage means, selectively engageable clutch means drivably interconnecting the engine and the fluid pump means and said means for generating negative pressure control means including a plurality of control switches, at least one of which is activated when the vehicle is parked and it is safe to operate the cleaning unit, said clutch means engageable only when the vehicular unit is parked activating said at least one control switch, and at least a second control switch remote from the driver's seat is activated, and remote cleaning means attachable to said storage means and said supply means whereby the operator may perform the cleaning remote from the vehicle.

* * * * *